US010195628B2

(12) United States Patent
Han

(10) Patent No.: US 10,195,628 B2
(45) Date of Patent: Feb. 5, 2019

(54) CLAMPING APPARATUS AND METHOD OF MANUFACTURING A MASK USING THE SAME

(71) Applicant: Samsung Display Co., Ltd., Yongin-si (KR)

(72) Inventor: Jeongwon Han, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/172,093

(22) Filed: Jun. 2, 2016

(65) Prior Publication Data

US 2017/0106391 A1 Apr. 20, 2017

(30) Foreign Application Priority Data

Oct. 16, 2015 (KR) ..... 10-2015-0144825

(51) Int. Cl.
*B05B 15/04* (2006.01)
*B05C 17/08* (2006.01)
(Continued)

(52) U.S. Cl.
CPC ..... *B05B 12/20* (2018.02); *B05B 12/24* (2018.02); *B25B 5/087* (2013.01); *B05B 12/29* (2018.02);
(Continued)

(58) Field of Classification Search
CPC ..... B25B 5/02; B25B 5/006; B05B 15/045; B05B 15/0481; B05B 12/29; Y10T 29/49863; Y10T 29/49867
(Continued)

(56) References Cited

U.S. PATENT DOCUMENTS 2,888,257 A * 5/1959 Taylor ..... F16C 1/20 174/176
3,277,836 A * 10/1966 Jooste ..... F04B 13/00 417/553
(Continued)

FOREIGN PATENT DOCUMENTS

JP 2006-169587 6/2006
JP 2006169587 A * 6/2006
(Continued)

OTHER PUBLICATIONS

JP 200619587, Method and Device for Mounting Metal Mask; Tsuchiya et al. EPO English machine translation; Mar. 1, 2017; pp. 1-8.*
(Continued)

*Primary Examiner* — Bayan Salone
(74) *Attorney, Agent, or Firm* — H.C. Park & Associates, PLC

(57) ABSTRACT

A clamping apparatus includes a clamping frame, a first guide, a clamp, a linear driver, and a pressure sensor. The first guide is disposed on the clamping frame. The clamp is slideably engaged with the first guide, the clamp being configured to linearly move along the first guide to adjust a distance between the clamp and the clamping frame. The linear driver is connected to the clamp, the linear driver being configured to cause, at least in part, linear motion of the clamp. The pressure sensor is configured to sense pressure applied to an object clamped between the clamp and the clamping frame.

17 Claims, 3 Drawing Sheets

(51) Int. Cl.

| | |
|---|---|
| ***B05B 12/20*** | (2018.01) |
| ***B25B 5/08*** | (2006.01) |
| ***B05B 12/24*** | (2018.01) |
| *B25B 5/00* | (2006.01) |

(52) U.S. Cl.
CPC ..... *B25B 5/006* (2013.01); *Y10T 29/49863* (2015.01); *Y10T 29/49867* (2015.01)

(58) Field of Classification Search
USPC ..... 29/446, 448; 269/43, 156, 228
See application file for complete search history.

(56) References Cited

U.S. PATENT DOCUMENTS

| | | | | |
|---|---|---|---|---|
| 5,534,969 | A * | 7/1996 | Miyake | G03F 7/707 250/559.3 |
| 5,688,014 | A * | 11/1997 | Kot | B25B 5/122 269/224 |
| 5,961,109 | A * | 10/1999 | Dykstra | B25B 5/12 269/196 |
| 9,328,407 | B2 * | 5/2016 | Lee | C23C 14/042 |
| 9,567,662 | B2 * | 2/2017 | Kim | H01L 51/0011 |
| 2012/0279445 | A1 * | 11/2012 | Kim | H01L 51/0011 118/504 |
| 2014/0158045 | A1 * | 6/2014 | Lee | C23C 14/042 118/505 |

FOREIGN PATENT DOCUMENTS

| | | | | |
|---|---|---|---|---|
| KR | 10-2008-0090262 | | 10/2008 | |
| KR | 20080090262 | A * | 10/2008 | |
| KR | 10-2011-0046782 | | 5/2011 | |
| KR | 10-2012-0113574 | | 10/2012 | |
| KR | 20120113574 | A * | 10/2012 | H01L 51/56 |
| KR | 10-2012-0125038 | | 11/2012 | |
| KR | 10-1322663 | | 10/2013 | |
| KR | 101322663 | B1 * | 10/2013 | |
| KR | 10-1328546 | | 11/2013 | |
| KR | 10-2014-0007582 | | 1/2014 | |
| KR | 10-1352353 | | 1/2014 | |

OTHER PUBLICATIONS

KR 101322663; Tension Clamp Device; Kim, Ju Hoan; EPO English machine translation; Mar. 1, 2017; pp. 1-8.*
Kim, Clamp Unit and Apparatus for Manufacturing a Mask . . . EPO English Machine Translation; Feb. 27, 2018; pp. 1-5.*
"Tactilus Free Form Sensor System", (http://www.sensorprod.com/pdf/Tactilus-Free-Form.pdf), Oct. 9, 2014, Sensor Products Inc., Internet.
Free Form Pressure Sensor Array Shapes and Sizes, (http://www.sensorprod.com/campaign/dynamic-pressure-sensors/index.php?mcode=gc-pressure).
Prescale Pressure Film, (http://blog.naver.com/asts195?redirect=log&logno=220315692330), Mar. 30, 2015.
Prescale Pressure Film, (http://wooshin74.blog.me/220208013441), Dec. 12, 2014.

* cited by examiner

CLAMPING APPARATUS AND METHOD OF MANUFACTURING A MASK USING THE SAME

CROSS-REFERENCE TO RELATED APPLICATION

This application claims priority from and the benefit of Korean Patent Application No. 10-2015-0144825, filed on Oct. 16, 2015, which is hereby incorporated by reference for all purposes as if fully set forth herein.

BACKGROUND

Field

Exemplary embodiments relate to electronic devices, and, more particularly, to clamping apparatuses and methods of manufacturing masks using the same.

Discussion of the Background

Mobile electronic devices, such as mobile phones, notebook computers, personal digital assistants, tablets, etc., are widely used. These devices typically include a display unit to provide users with visual information, such as an image or video information, in order to support various functions. Components for driving display units have become smaller, but the display units themselves have become more important in conventional mobile electronic devices. It is also noted that a structure for bending a display unit from a first (e.g., flat) state to a second (e.g., bended at a certain angle) state has been developed. To manufacture the display unit, various deposition devices may be used. The deposition devices may utilize a mask frame assembly manufactured by arranging a mask sheet on a frame, tensioning the mask sheet, and fixing the mask sheet to the frame. Various devices to tension a mask sheet have been developed.

The above information disclosed in this Background section is only for enhancement of understanding of the background of the inventive concept, and, therefore, it may contain information that does not form the prior art that is already known to a person of ordinary skill in the art.

SUMMARY

One or more embodiments provide a clamping apparatus configured to prevent deformation or fracture of a mask sheet when non-uniform pressure is applied to ends of the mask sheet during a tensioning process.

One or more embodiments provide a method of manufacturing a mask using the clamping apparatus.

Additional aspects will be set forth in the detailed description which follows, and, in part, will be apparent from the disclosure, or may be learned by practice of the inventive concept.

According to one or more exemplary embodiments, a clamping apparatus includes a clamping frame, a first guide, a clamp, a linear driver, and a pressure sensor. The first guide is disposed on the clamping frame. The clamp is slideably engaged with the first guide, the clamp being configured to linearly move along the first guide to adjust a distance between the clamp and the clamping frame. The linear driver is connected to the clamp, the linear driver being configured to cause, at least in part, linear motion of the clamp. The pressure sensor is configured to sense pressure applied to an object clamped between the clamp and the clamping frame.

According to one or more exemplary embodiments, a method of manufacturing a mask includes: causing, at least in part, a pressure applied to a mask clamped between a clamp and a frame to be determined, the pressure being applied to the mask according to linear motion of the clamp in a first direction; causing, at last in part, a driver to linearly move a block in a second direction according to a result of the determination, the second direction crossing the first direction; and causing, at least in part, the mask to be tensioned according to linear motion of the frame. An assembly coupled between the clamp and the block is configured to convert linear motion of the block in the second direction into linear motion of the clamp in the first direction.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
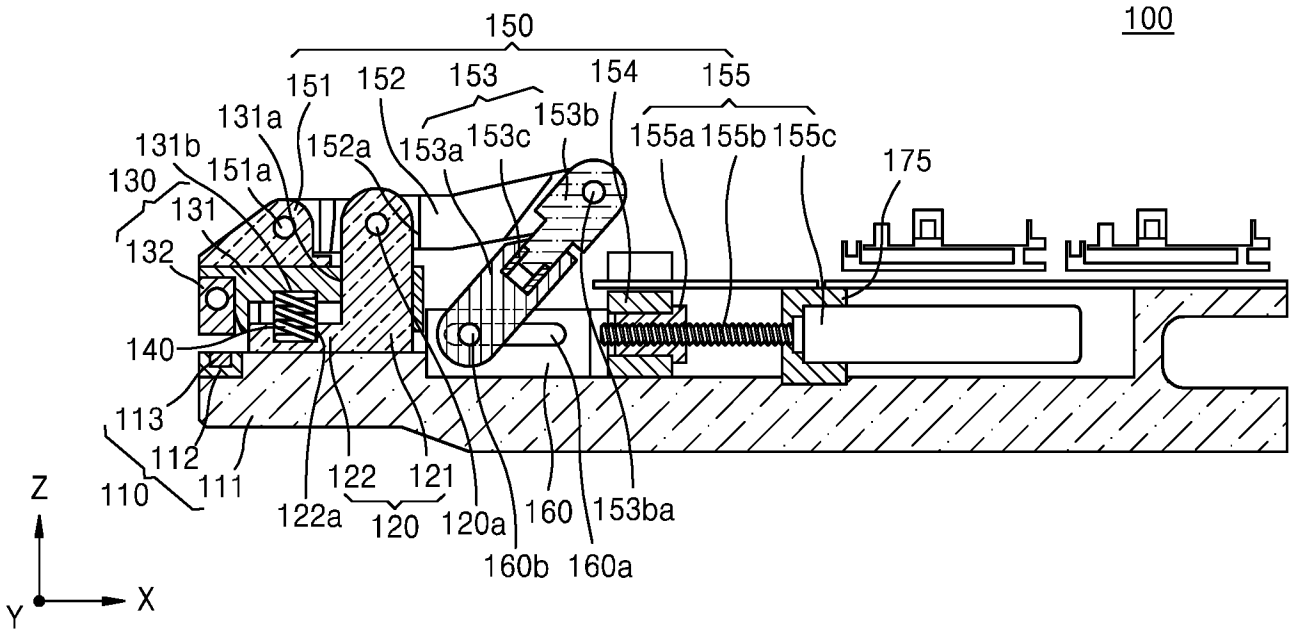
FIG. 1 is a cross-sectional view of a clamping apparatus, according to one or more exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

Unless otherwise specified, the illustrated exemplary embodiments are to be understood as providing exemplary features of varying detail of various exemplary embodiments. Therefore, unless otherwise specified, the features, components, modules, layers, films, panels, regions, and/or aspects of the various illustrations may be otherwise combined, separated, interchanged, and/or rearranged without departing from the disclosed exemplary embodiments. Further, in the accompanying figures, the size and relative sizes of layers, films, panels, regions, etc., may be exaggerated for clarity and descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. Further, the x-axis, the y-axis, and the z-axis are not limited to three axes of a rectangular coordinate system, and may be interpreted in a broader sense. For example, the x-axis, the y-axis, and the z-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms "first," "second," etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various exemplary embodiments are described herein with reference to sectional illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Figure 2:
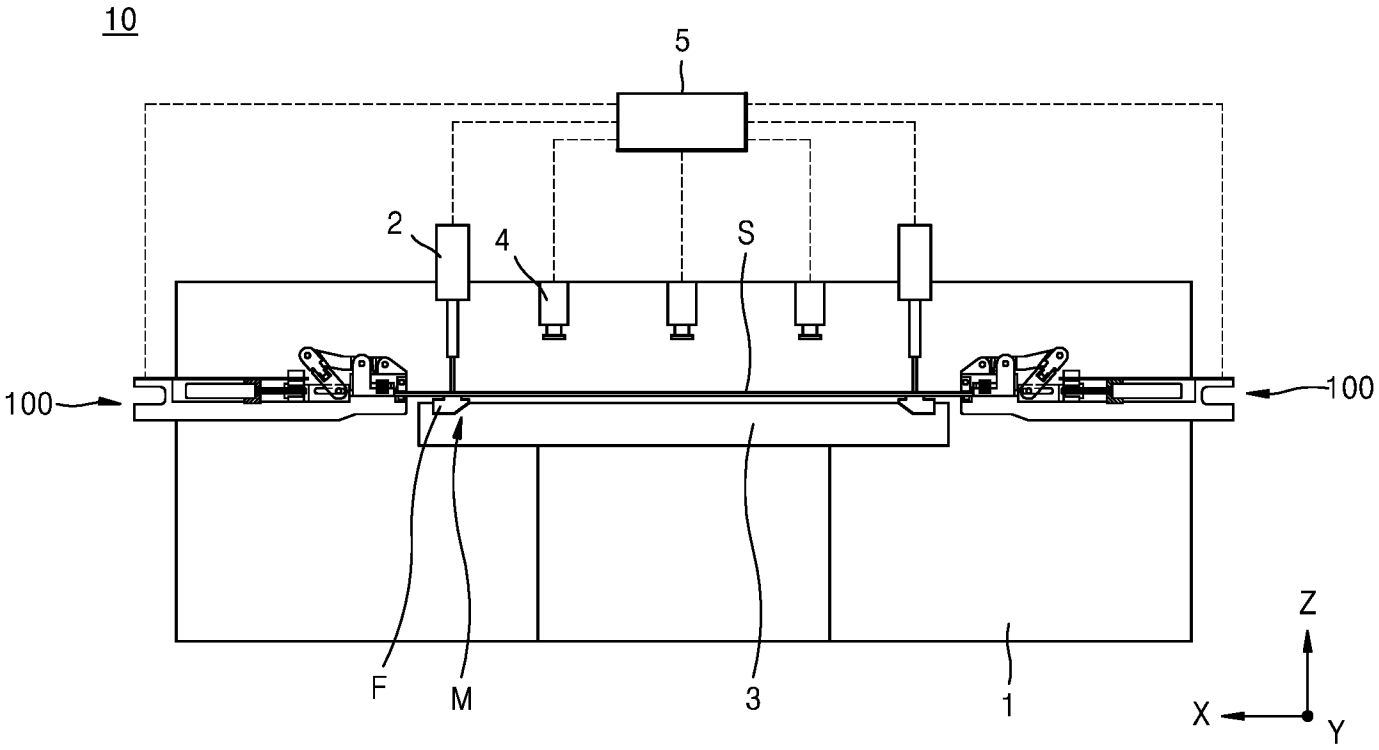
FIG. 2 is a conceptual view of a mask frame assembly manufacturing apparatus including the clamping apparatus of FIG. 1, according to one or more exemplary embodiments.

FIG. 1 is a cross-sectional view of a clamping apparatus, according to one or more exemplary embodiments. FIG. 2 is a conceptual view of a mask frame assembly manufacturing apparatus including the clamping apparatus of FIG. 1, according to one or more exemplary embodiments.

Referring to FIGS. 1 and 2, the clamping apparatus 100 may include a clamping frame unit 110, a first guide unit 120, a clamping unit 130, an elasticity unit (or biasing member) 140, a linear driving unit 150, and a second guide unit 160. Although specific reference will be made to this particular implementation, it is also contemplated that the clamping apparatus 100 may embody many forms and include multiple and/or alternative components.

The clamping frame unit 110 may include a clamping frame 111 and a mounting unit 112 disposed (e.g., mounted, coupled, etc.) at (or near) an end portion of the clamping frame 111. The mounting unit 112 may face the clamping unit 130 and may be configured to clamp a mask sheet S (not shown). A pressure sensor 113 may be disposed in (or otherwise associated with) the mounting unit 112. The pressure sensor 113 may be mounted on a surface of the mounting unit 112 facing an end portion of the clamping unit 130. FIG. 1 illustrates the pressure sensor 113 being laid in a groove formed in the mounting unit 112; however, exemplary embodiments are not limited thereto. For example, the pressure sensor 113 may occupy an entire surface of the mounting unit 112.

When the mask sheet S is clamped via the clamping apparatus 100, the pressure sensor 113 may sense pressure applied to the mask sheet S. For instance, the pressure sensor 113 may sense pressure applied to the mask sheet S in real time, and clamping (e.g., clamping forces, clamping position, etc.) may be adjusted according to the sensing results, e.g., output of the pressure sensor 113. Accordingly, stable clamping conditions may be provided according to one or more exemplary embodiments.

A driving unit 155 that will be described in more detail may be controlled to provide a distribution of pressure (e.g., uniform distribution of pressure) to the mask sheet S, which may be sensed and adjusted based on output of the pressure sensor 113. As such, when a uniform distribution of pressure is applied to the mask sheet S, the mask sheet S may be prevented (or at least reduced) from being fractured, scratched, or otherwise damaged by the mounting unit 112 or a clamping block 132, which will be described in more detail later. Also, deformation of a portion of the mask sheet S may be prevented (or at least reduced). If the deformation of the mask sheet S is reduced, a deposition pattern may be more precisely formed on the mask sheet S. Further, a deposition material may be more precisely and uniformly deposited on a substrate (not shown), e.g. a substrate of a display apparatus, when utilized in association with, for instance, a deposition manufacturing process. Accordingly, a yield rate of an apparatus including the substrate having features formed utilizing the mask sheet S may be increased, which may decrease per unit costs and manufacturing time.

The first guide unit 120 may be disposed (e.g., mounted, fixed, coupled, etc.) on the clamping frame 111. To this end, the first guide unit 120 may include a first linear guide unit 121 inserted into (or otherwise connected to) the clamping unit 130. The first linear guide unit 121 may be configured to guide motion of the clamping unit 130, such as configured to restrict motion of the clamping unit 130 in the Z axis direction along a length of the first linear guide unit 121. The first linear guide unit 121 may be formed in a direction (e.g., a Z axis direction of FIG. 1) intersecting the clamping frame 111. It is also noted that the first guide unit 120 may include a fixing unit 122 protruding (or extended) from the first linear guide unit 121. The fixing unit 122 may be configured to fix a location of the elasticity unit 140. Further, the fixing unit 122 may protrude in a direction parallel with clamping frame 111 (or an opposite direction of an X axis direction of FIG. 1).

According to one or more exemplary embodiments, the clamping unit 130 may receive the first guide unit 120, and may linearly move along a portion of the first guide unit 120, e.g., a portion corresponding to the first linear guide unit 121. The clamping unit 130 may include a moving block 131 into which the first linear guide unit 121 is inserted. The moving block 131 may linearly move along the first linear guide unit 121 according to guidance of the first linear guide unit 121. In one or more exemplary embodiments, a first insertion hole 131*a* and a second insertion groove 131*b* may be formed in the moving block 131. The first insertion hole 131*a* may receive the first linear guide unit 121, and the second insertion groove 131*b* may receive the elasticity unit 140. In this manner, the first insertion hole 131*a* may correspond to a through-hole, e.g., a through-mortise, etc., in the clamping unit 130. The second insertion groove 131*b* faces a first insertion groove 122*a* that receives a portion of the elasticity unit 140 in the first guide unit 120. The clamping unit 130 may further include the clamping block 132 coupled to the moving block 131. In one or more exemplary embodiments, the clamping unit 130 may be coupled to the moving block 131 via a pin, etc. The clamping block 132 may be arranged to face the mounting unit 112.

The elasticity unit 140 may be disposed between the moving block 131 and the fixing unit 122. The elasticity unit 140 may provide resilience (e.g., a biasing force) to the moving block 130 when the moving block 131 moves, such as moves counter to the biasing force. The elasticity unit 140 may include an elastic material, such as rubber, silicon, metal, etc., and may have a form, such as a spring, a bar, etc. As seen in FIG. 1, the elasticity unit 140 is provided as a compression spring including a metal material; however, aspects of the elasticity unit 140 are not limited thereto.

The linear driving unit 150 may include a pressurizing unit 151, a connection link 152, a rotation link 153, a linear moving block 154, and the driving unit 155.

The pressurizing unit 151 may pressurize the clamping unit 130 by moving in accordance with motion of the driving unit 155. The pressurizing unit 151 may be mounted (or otherwise coupled) to the connection link 152 via a pin, etc, and may rotate about an axis corresponding to the connection point, e.g., about the pin. For instance, the pressurizing unit 151 may be connected to the connection link 152 at a connection point 151*a*, and, as such, may be configured to rotate with respect to an axis of connection point 151*a* extending in a direction, such as a Y axis direction of FIG. 1. To this end, the pressurizing unit 151 may have a surface in contact with the moving block 131.

The connection link 152 may be connected to an end portion of the first guide unit 120 at a connection point 120*a*, and may be rotatable with respect to the corresponding end portion of the first guide unit 120, e.g., rotatable about an axis of the connection point 120*a* extending in a direction, such as a Y axis direction. However, the connection link 152 may be connected to another portion of the first guide unit 120 that enables the connection link 152 to rotate with respect to the other portion of the first guide unit 120.

The connection link 152 may be formed having at least one inclined, curved, or otherwise bent portion. For example, the connection link 152 between a first portion connected to the first guide unit 120 and a second portion connected to the pressurizing unit 151 may be formed having a linear (or substantially linear) shape (e.g., between connection point 151*a* and connection point 120*a*), and the connection link 152 between the second portion connected to the first guide unit 120 (or a third portion protruding from the second portion) and a fourth portion connected to the rotation link 153 may be formed to have an inclined shape (e.g., between a portion extending from the second portion connected to connection point 120*a* and another connection point 153*ba*). For instance, the connection link 152 between the first portion connected to the pressurizing unit 151 and the second portion connected to the first guide unit 120 may extend in an X axis direction of FIG. 1, and the connection link 152 between the second portion connected to the first guide unit 120 (or the third portion) and the fourth portion connected to the rotation link 153 may extend in a direction intersecting the X axis direction, e.g., a direction rotated from the X axis direction.

A second insertion hole 152*a*, into which the first guide unit 120 is inserted, may be formed in the connection link 152. For example, the second insertion hole 152*a* may be a mortise (e.g., through-mortise) formed in the connection link 152. In this manner, an end portion of the first guide unit 120 may be inserted into the second insertion hole 152*a* and sidewalls of the second insertion hole 152*a* may surround the end portion of the first guide unit 120. The connection link 152 may be rotatable with respect to the end portion of the first guide unit 120, e.g., about an axis of the connection point 120*a*. As such, the second insertion hole 152*a* may have a larger width in the X axis direction than a width in the X axis direction of the end portion of the first guide unit 120 inserted into the second insertion hole 152*a*. Although not illustrated in FIG. 1, the end portion of the first guide unit 120 may be formed as a tendon.

According to one or more exemplary embodiments, a distance between the second portion of the connection link 152 connected to the first guide unit 120 and the first portion of the connection link 152 connected to the moving block 131 may be less than a distance between the second portion of the connection link 152 connected to the first guide unit 120 and the fourth portion of the connection link 152 connected to the rotation link 153. For instance, a distance between connection point 151*a* and connection point 120*a* may be less than a distance between connection point 120*a* and the connection point 153*ba*.

The rotation link 153 may include a damper guide link 153*a*, a moving link 153*b*, and a connection elasticity unit 153*c*. The damper guide link 153*a* may be connected to the linear moving block 154 and may be rotatable, as well as translatable with respect to second guide unit 160 via guide hole (or slot) 160*a*. In one or more exemplary embodiments, the damper guide link 153*a* may be inserted into the second guide unit 160, as will become more apparent below.

The moving link 153*b* may be connected to the damper guide link 153*a* and the connection link 152 via connection point 153*ba*. The connection elasticity unit 153*c* may be provided between the moving link 153*b* and the damper guide link 153*a*. The connection elasticity unit 153*c* may provide resilience (e.g., a biasing force) between the moving link 153*b* and the damper guide link 153*a*. The connection elasticity unit 153*c* may include an elastic material, such as rubber, silicon, metal, etc., and may have a form, such as a spring, a bar, etc. For example, the connection elasticity unit 153*c* may have a ring shape and may be inserted in association with an interfacing portion between the moving link 153*b* and the damper guide link 153*a*. In this manner, the damper guide link 153*a* may include a recessed portion in which the connection elasticity unit 153*c* is disposed, and the moving link 153*b* may include a protrusion portion inserted in the recessed portion of the damper guide link 153*a* and an opening in the ring-shaped connection elasticity unit 153*c*. To this end, the protrusion portion of the moving link 153*b* may be stepped to enable a first portion of the protrusion portion to extend into the opening in the ring-shaped connection elasticity unit 153*c* and a second portion of the protrusion portion to interface with a first (e.g., upper) surface of the ring-shaped connection elasticity unit 153*c*. A second (e.g., lower) surface of the ring-shaped connection elasticity unit 153*c* may interface with a surface of the recessed portion of the damper guide link 153*a*.

The linear moving block 154 may be connected to the damper guide link 153*a*. The linear moving block 154 may interface with the second guide unit 160 mounted on the clamping frame 111. In one or more exemplary embodiments, the second guide unit 160 may include two plates facing each other, and an end portion of the moving link 153*b* may be inserted in an inner cavity disposed between the two facing plates. In this manner, an outer surface of the second guide unit 160 may be formed surrounding the linear moving block 154. As such, a surface of the second guide unit 160 may be formed having a guide hole 160*a* into which, for instance, a pin for connecting the linear moving block 154 and the damper guide link 153*a*, is inserted. The pin may connect the linear moving block 154 and the damper guide link 153*a* via a connection point 160*b*, and the pin may move in the guide hole 160*a* based on a motion of the linear moving block 154. In this manner, the guide hole 160*a* may guide a linear motion of the pin. Further, the damper guide link 153*a* may rotate about an axis of rotation extending out of the page (e.g., in the Y axis direction) in association with the connection point 160*b*.

The driving unit 155 may include a screw guide bracket 155*a* connected to the linear moving block 154, a screw 155*b* connected to the screw guide bracket 155*a*, and a motor 155*c* connected to the screw 155*b* and configured to rotate the screw 155*b*. The motor 155*c* may be coupled to a motor fixing unit 175 disposed on the clamping frame 111. It is contemplated, however, that any other suitable driving unit configured to effectuate linear motion of the linear moving block 154 in, for instance, the X axis direction may be utilized in association with exemplary embodiments described herein.

Adverting to FIG. 2 (with continued reference to FIG. 1), the mask assembly manufacturing apparatus 10 may include at least one clamping apparatus, such as the clamping apparatus 100 or the clamping apparatus 200 of FIG. 3, which will be described in more detail later. The mask assembly manufacturing apparatus 10 may further include a chamber 1, a welding unit 2, a supporting unit 3, a vision unit 4, and a controlling unit 5. Although specific reference will be made to this particular implementation, it is also contemplated that the mask assembly manufacturing apparatus 10 may embody many forms and include multiple and/or alternative components.

In general, a mask frame F may be mounted in the supporting unit 3, and the mask sheet S may be clamped in the clamping apparatus 100. In one or more exemplary embodiments, the mask sheet S may be tensioned in a length direction thereof after the mask sheet S is clamped in the clamping apparatus 100. The welding unit 2 may weld and couple the tensioned mask sheet S and the mask frame F together. Thereafter, a portion of the mask sheet S may be cut to form the mask assembly M.

As part of the above described operation, the vision unit 4 may be utilized to determine locations of the mask sheet S and the mask frame F, as well as to arrange at least one of the locations of the mask sheet S and the mask frame F. The vision unit 4 may photograph a location of welding, etc., so as to check whether the welding is accurately performed. It is contemplated, however, that any suitable vision unit may be utilized in association with exemplary embodiments described herein.

The controlling unit 5 may control components of the mask assembly manufacturing apparatus 10. In one or more exemplary embodiments, the controlling unit 5 may control the clamping apparatus 100. In one or more exemplary embodiments, the controlling unit 5 may control the mask assembly manufacturing apparatus 10. It is also contemplated that the controlling unit 5 may control both the clamping apparatus 100 and the mask assembly manufacturing apparatus 10.

In exemplary embodiments, the controlling unit 5 and/or one or more components thereof, may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like. In this manner, the features, functions, processes, etc., of the controlling unit 5 may be implemented via software, hardware (e.g., general processor, digital signal processing (DSP) chip, an application specific integrated circuit (ASIC), field programmable gate arrays (FPGAs), etc.), firmware, or a combination thereof. In this manner, the controlling unit 5 and/or one or more components thereof may include or otherwise be associated with one or more memories (not shown) including code (e.g., instructions) configured to cause components of the mask assembly manufacturing apparatus 10 and/or one or more components thereof to perform one or more of the features, functions, processes, etc., described herein.

A method of clamping the mask sheet S, according to one or more exemplary embodiments, may include an end of the mask sheet S being arranged between the clamping unit 130 and the clamping frame unit 110. After the mask sheet S is arranged between the clamping unit 130 and the clamping frame unit 110, the driving unit 155 may operate to move the linear moving block 154, such as operate to move the linear moving block based on output of the pressure sensor 112. The motor 155*c* may operate to rotate the screw 155*b* so that the screw guide bracket 155*a* moves. The screw guide bracket 155*a* may move in an x axis direction of FIG. 1, and the linear moving block 154 may move in the same direction as the screw guide bracket 155*a* along the second guide unit 160, and, thereby, along the clamping frame 111.

When the linear moving block 154 moves as described above, the linear moving block 154 may translate and/or rotate the damper guide link 153*a*. Also, the linear moving block 154 may further cause rotation of the moving link 153*b* connected to the damper guide link 153*a*. A vertical distance between the linear moving block 154 and an uppermost surface of the moving link 153*b* may increase or decrease based on a direction of the motion of the linear moving block 154. When the damper guide link 153*a* moves, the connection link 152 may rotate in a clockwise or counterclockwise direction. When, for instance, the connection link 152 rotates in a counterclockwise direction about an axis of rotation associated with connection point 120*a*, the pressurizing unit 151 may exert a pressure on the moving block 131 towards clamping frame 111, e.g., in an opposite direction of the Z axis. The moving block 131 may move towards the clamping frame unit 110 to become more adjacent to the clamping frame unit 110. To this end, the clamping block 132 and the mounting unit 112 may become more adjacent to each other to clamp the mask sheet S. As such, the moving block 131 may move in the opposite direction of the Z axis along the first linear guide unit 121. That is, the moving block 131 may linearly move along the first linear guide unit 121 towards clamping frame 111, as well as may be biased in an opposite direction (e.g., away from clamping frame 111) via elasticity unit 140.

To release a clamping pressure applied to the mask sheet S, the controlling unit 5 may control the driving unit 155 to operate to rotate the motor 155*c* in the opposite direction as described above. For instance, the screw 155*b* may rotate to move the screw guide bracket 155*a* in an opposite direction of the X axis direction of FIG. 1. In this manner, the rotation link 153 may be moved and rotated in the opposite direction, and the connection link 152 may be rotated in a clockwise direction about an axis of rotation associated with connection point 120*a*. To this end, a force applied to the moving block 131 by the pressurizing unit 151 may be diminished, and the elasticity unit 140 may also apply pressure to the moving block 131 in the Z axis direction. As such, the moving block 131 may move in the Z axis direction of FIG. 1 along the linear guide unit 121, and the clamping block 132 may be distanced from the mounting unit 112 to release the clamping pressure applied to the mask sheet S.

According to one or more exemplary embodiments, the clamping apparatus 100 linearly moves the clamping block 132 in a direction intersecting a surface of the clamping frame unit 110, e.g., in a direction perpendicular to an upper surface of the clamping frame 111. In this manner, when the mask sheet S is clamped, deformation of the mask sheet S may be minimized via a surface contact of the clamping block 132 and the mask sheet S. Further, the controlling unit 5 may control the clamping pressure applied to the mask sheet S based on a determined threshold pressure (e.g., a maximum pressure) that may be applied to mask sheet S, a uniformity of pressure applied to the mask sheet S, etc., each of which may be determined in association with pressure sensor 113. It is also noted that the controlling unit 5 may cause linear translation of the clamping frame unit 110 to tension the mask sheet S between clamping apparatuses 100, e.g., tension the mask sheet S along the X axis direction.

According to one or more exemplary embodiments, a mounting space of the clamping apparatus 100 may be minimized by vertically arranging devices for clamping the mask sheet S and devices for operating to apply a tensile force to the mask sheet S. Further, distance from a rotation center of the connection link 152 to opposing ends of the connection link 152 may be formed to be different from each other in order to generate a leverage effect. As such, the mask sheet S may be clamped by a small force. Accordingly, the clamping apparatus 100 may clamp the mask sheet S by consuming less energy by the driving unit 155.

Figure 3:
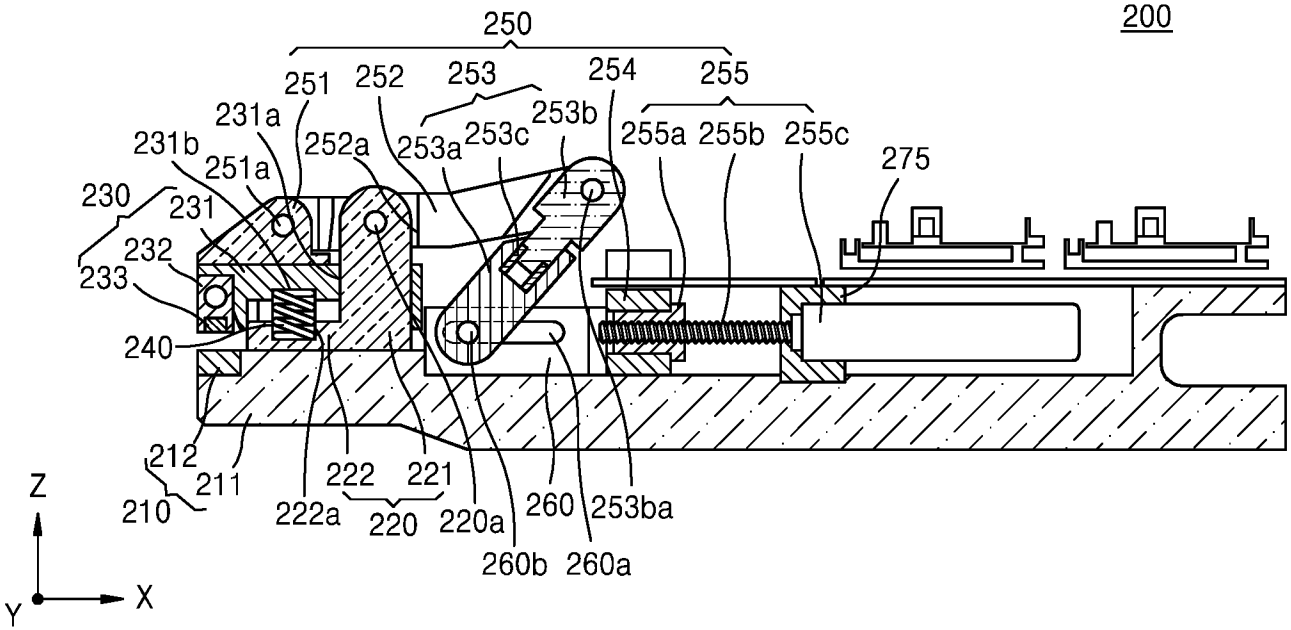
FIG. 3 is a cross-sectional view of a clamping apparatus, according to one or more exemplary embodiments.

FIG. 3 is a cross-sectional view of a clamping apparatus, according to one or more exemplary embodiments. The clamping apparatus of FIG. 3 is similar to the clamping apparatus of FIG. 1, and, as such, duplicative descriptions have been limited to avoid obscuring exemplary embodiments described herein.

Referring to FIG. 3, the clamping apparatus 200 may include a clamping frame unit 210, a first guide unit 220, a clamping unit 230, an elasticity unit 240, a linear driving unit 250, and a second guide unit 260. The clamping frame unit 210 and the clamping unit 230 of the clamping apparatus 200 illustrated in FIG. 3 are different from the clamping frame unit 110 and the clamping unit 130 illustrated in FIG. 1. The first guide unit 220, the elasticity unit 240, the linear driving unit 250, and the second guide unit 260 may be configured and operate in a similar manner to the first guide unit 120, the elasticity unit 140, the linear driving unit 150, and the second guide unit 160 described with reference to FIG. 1, respectively. As such, duplicative descriptions will be omitted to avoid obscuring exemplary embodiments described herein.

The clamping frame unit 210 may include a clamping frame 211 and a mounting unit 212 mounted at an end portion of the clamping frame 211. The mounting unit 212 may face the clamping unit 230 and may clamp a mask sheet S (not shown).

The clamping unit 230 may receive the first guide unit 220 in first insertion hole 231*a*, and linearly move along a portion of the first guide unit 220 when the linear driving unit 250 and/or the elasticity unit 240 pressurize the clamping unit 230. The clamping unit 230 may include a moving block 231 into which a first linear guide unit 221 is inserted. The moving block 231 may linearly move along the first linear guide unit 221. In one or more exemplary embodiments, a first insertion hole 231*a* and a second insertion groove 231*b* may be formed in the moving block 231. The first insertion hole 231*a* may receive the first guide unit 220 so that the first guide unit 220 may interface with the clamping unit 230. The second insertion groove 231*b* may receive the elasticity unit 240 so that the elasticity unit 240 is biased between the clamping unit 230 and the first guide unit 220.

The clamping unit 230 may further include a clamping block 232 coupled to the moving block 231. The clamping block 232 may be coupled to the moving block 231 via a pin, etc. The clamping block 232 may be arranged to face the mounting unit 212. The clamping unit 230 may further include a pressure sensor 233. The pressure sensor 233 may be mounted in the clamping block 232. The pressure sensor 233 may be mounted at a surface of the clamping block 232 facing an end portion of the clamping frame unit 210. In one or more exemplary embodiments, the pressure sensor 233 may be laid in a groove formed in the clamping block 232 as shown in FIG. 3, however, exemplary embodiments are not limited thereto. For example, the pressure sensor 233 may be mounted on an entire surface of the clamping block 232.

When the mask sheet S shown in FIG. 2 is clamped, the pressure sensor 233 may sense a pressure and/or a distribution of pressure applied to the mask sheet S. The pressure sensor 233 may sense the pressure applied to the mask sheet S in real time, and clamping may be stopped when excessive pressure is applied to the mask sheet S. Further, clamping forces may be adjusted to ensure a uniform application of pressure to the mask sheet S. Accordingly, stable clamping may be provided according to one or more exemplary embodiments.

A driving unit 255 may be controlled to provide an uniform distribution of pressure applied to the mask sheet S via the pressure sensor 233. When the uniform pressure is applied to the mask sheet S, the mask sheet S may be prevented (or at least reduced) from being fractured, scratched, or otherwise damaged by the mounting unit 212 or the clamping block 232. Also, deformation of a portion of the mask sheet S may be prevented (or at least reduced). If the deformation of the mask sheet S is reduced, a deposition pattern may be precisely formed in the mask sheet S. This may enable a deposition material to be precisely and uniformly deposited on a substrate, e.g. a substrate of a display apparatus, utilizing the mask sheet S. Accordingly, a yield rate of an apparatus including the substrate having features formed utilizing the mask sheet S may be increased, which may decrease per unit costs and manufacturing time.

According to one or more exemplary embodiments, the pressure sensors 113 and 233 may be formed in (or at least interface with) at least one of the clamping frame units 110 and 210 and the clamping units 130 and 230 illustrated in FIGS. 1 and 3. For example, the pressure sensors 113 and 233 may be formed in both of the clamping frame units 110 and 210 and the clamping units 130 and 230. Further, the pressure sensors 113 and 233 may correspond to arrays (or matrices) of pressure sensors configured to sense a distribution of pressure applied to the mask sheet S. To this end, the pressure sensors 113 and 233 may be aligned or offset from one another when the associated clamping apparatus is viewed in a plan view.

According to one or more exemplary embodiments, the clamping apparatuses 100 and 200 may prevent deformation, fracture, and/or damage to the mask sheet S by monitoring a clamping pressure in real time and controlling the clamping pressure applied to the mask sheet S based on the monitoring results.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A clamping apparatus comprising:
- a clamping frame;
- a first guide disposed on the clamping frame;
- a clamp slideably engaged with the first guide, the clamp being configured to linearly move along the first guide in a direction intersecting the clamping frame to adjust a distance between the clamp and the clamping frame;
- a linear driver connected to the clamp, the linear driver being configured to cause, at least in part, linear motion of the clamp; and
- a pressure sensor configured to sense pressure applied to an object clamped between the clamp and the clamping frame.

2. The clamping apparatus of claim 1, further comprising:
- a biasing member disposed between the clamping frame and the clamp, the biasing member being configured to bias the linear motion of the clamp.

3. The clamping apparatus of claim 2, wherein the first guide comprises:
- a linear guide portion interfacing with the clamp, the linear guide portion being configured to guide the linear motion of the clamp; and
- a fixing portion protruding from the linear guide portion, the fixing portion interfacing with the biasing member.

4. The clamping apparatus of claim 1, wherein the clamp comprises:
- a moving block interfacing with the first guide, the moving block being configured to linearly move along the first guide in accordance with linear motion of the linear driver; and
- a clamping block coupled to an end portion of the moving block, the clamping block being configured to interface with the object.

5. The clamping apparatus of claim 1, wherein:
- the linear driver comprises:
  - a pressurizing portion configured to apply pressure to the clamp;
  - a connection link connected to the pressurizing portion and rotatably connected to the first guide;
  - a rotation link connected to the connection link;
  - a linear moving block coupled to the rotation link; and
  - a driver connected to the linear moving block, the driver being configured to cause, at least in part, linear motion of the linear moving block along the clamping frame; and
- the rotation link is configured to cause, at least in part, motion of the connection link according to the linear motion of the linear moving block.

6. The clamping apparatus of claim 5, further comprising:
- a second guide coupled to the clamping frame,
- wherein the second guide is configured to guide the linear motion of the linear moving block.

7. The clamping apparatus of claim 5, wherein the connection link comprises:
- a first portion extending in a first direction; and
- a second portion extending from the first portion in a second direction crossing the first direction.

8. The clamping apparatus of claim 5, wherein the rotation link comprises:
- a damper guide link coupled to the linear moving block;
- a moving link coupled to the damper guide link and the connection link; and
- a biasing member disposed between the damper guide link and the moving link to bias relative motion between the damper guide link and the moving link.

9. The clamping apparatus of claim 7, wherein the second portion of the connection link arcuately extends from the first portion of the connection link.

10. The clamping apparatus of claim 5, wherein a direction of the linear motion of the clamp is different from a direction of linear motion of the linear moving block.

11. The clamping apparatus of claim 1, wherein the pressure sensor is coupled to the clamp.

12. The clamping apparatus of claim 1, wherein the pressure sensor is coupled to the clamping frame.

13. A clamping apparatus comprising:
- a clamping frame;
- a first guide disposed on the clamping frame;
- a clamp slideably engaged with the first guide, the clamp being configured to linearly move along the first guide to adjust a distance between the clamp and the clamping frame;

a linear driver connected to the clamp, the linear driver being configured to cause, at least in part, linear motion of the clamp;

a pressure sensor configured to sense pressure applied to an object clamped between the clamp and the clamping frame; and a biasing member disposed between the first guide and the clamp, the biasing member being configured to bias the linear motion of the clamp.

14. The clamping apparatus of claim 13, wherein:

the linear driver comprises:

a pressurizing portion configured to apply pressure to the clamp;

a connection link connected to the pressurizing portion and rotatably connected to the first guide;

a rotation link connected to the connection link;

a linear moving block coupled to the rotation link; and a driver connected to the linear moving block, the driver being configured to cause, at least in part, linear motion of the linear moving block along the clamping frame; and the rotation link is configured to cause, at least in part, motion of the connection link according to the linear motion of the linear moving block.

15. The clamping apparatus of claim 14, further comprising:

a second guide coupled to the clamping frame, wherein the second guide is configured to guide the linear motion of the linear moving block.

16. The clamping apparatus of claim 14, wherein a direction of the linear motion of the clamp is different from a direction of linear motion of the linear moving block.

17. The clamping apparatus of claim 14, wherein the first guide is disposed between the clamp and the linear moving block.

* * * * *